United States Patent [19]

Crankshaw et al.

[11] Patent Number: 4,830,701

[45] Date of Patent: May 16, 1989

[54] LABELING SYSTEM

[75] Inventors: Michael Crankshaw, Santa Fe Springs; Leo Kucheck, Irvine, both of Calif.

[73] Assignee: Label-Aire Inc., Fullerton, Calif.

[21] Appl. No.: 163,533

[22] Filed: Mar. 3, 1988

[51] Int. Cl.[4] ..... B65C 3/12

[52] U.S. Cl. ..... 156/448; 156/457; 156/458

[58] Field of Search ..... 156/361–363, 156/364, 446–450, 456–458

[56] References Cited

U.S. PATENT DOCUMENTS

| | | | |
|---|---|---|---|
| 1,700,005 | 1/1929 | Wall | 156/457 |
| 3,577,293 | 5/1971 | Ritterhoff | 156/450 X |
| 3,783,077 | 1/1974 | Wessmer | 156/449 X |
| 3,944,455 | 3/1976 | French | 156/542 X |
| 3,984,277 | 10/1976 | French et al. . | |
| 4,123,310 | 10/1978 | Varon et al. | 156/361 X |
| 4,124,429 | 11/1978 | Crankshaw . | |
| 4,129,473 | 12/1978 | Derret | 156/542 X |
| 4,314,869 | 2/1982 | Crankshaw | 156/361 X |
| 4,714,515 | 12/1987 | Hoffman | 156/450 |

*Primary Examiner*—David Simmons

*Attorney, Agent, or Firm*—Gordon L. Peterson; Loyal M. Hanson

[57] ABSTRACT

A labeling system includes a conveyor for moving articles to be labeled in a first direction through a labeling station while allowing the article to be rotated, and a label transport for conveying labels in a generally opposite second direction from a label dispensing station to the labeling station. Label dispensing components are provided for dispensing a label onto the label transport whereby the label transport can convey the label to the labeling station where the label contacts the article so that the label is transferred to the article. The conveyor may employ a nest for rotatably supporting the article that includes at least first and second rollers for supporting the article therebetween. A method of wrap around labeling includes the steps of moving an article to be labeled in a first direction to a label applying station, moving a label with an adhesive on a face thereof in a generally opposite second direction into the labeling station, contacting the face of the label and the article are both moving to transfer the label to the article, and rotating the article to apply the label to the article.

15 Claims, 3 Drawing Sheets

LABELING SYSTEM

BACKGROUND OF THE INVENTION

A wrap around label applicator typically applies a relatively long label to a peripheral curved surface, such as a cylindrical wall, of an article to be labeled. One example of a wrap around label applicator is shown in U.S. Pat. No. 4,124,429 to Crankshaw.

In a conventional wrap around label applicator, a label is releasably retained at a labeling station and the article to be labeled is conveyed through the labeling station, as shown, for example, in U.S. Pat. No. 3,984,277 to French et al. In moving through the labeling station, the article contacts the pressure sensitive adhesive face of the label to transfer the label to the article. The article is rotated as it moves through the labeling station to wrap the label around the article as the article moves through the labeling station.

In some wrap around label applicators, such as the one shown in the Crankshaw patent, the label is moved in the same direction as the article at the labeling station, but at a faster speed, so that the label can catch up to the article. After catching the label, the rotation of the article wraps the label around the article.

The above described wrap around labeling techniques are suitable for low line speeds, but not suited for higher volume labeling requirements. In high volume applications, it is desirable to move the article past the label more quickly, but conveyor belt speed limitations restrict how fast this can be done. Consequently, it is desirable to have a new and improved labeling system and related methodology that can accommodate higher volume labeling requirements.

SUMMARY OF THE INVENTION

This invention solves the problems associated with the prior art with a labeling system that moves the label in a direction opposite the direction in which the article is being conveyed. Thus, relative motion between the label and the article is increased without exceeding conveyor belt speed limitations.

Generally, a system constructed according to the invention includes a conveyor for moving articles to be labeled in a first direction through a labeling station while allowing the article to be rotated, and a label transport for conveying labels from a label dispensing station to the labeling station with the labels moving in a second direction at the labeling station. A label dispenser is provided for dispensing a label onto the label transport whereby the label transport can convey the label to the labeling station where the label contacts the article so that the label is transferred to the article.

According to a major aspect of the invention, the first and second directions are generally opposite to each other. According to another aspect of the invention, there is provided a conveyor that employs a nest with first and second rollers for rotatably supporting the article, the second roller trailing and projecting above the first roller to enhance retention of articles within the nest.

According to yet another aspect, a rotation initiator initiates rotation of the article before it reaches th labeling station to facilitate label application. A further aspect provides a conveyor in which alternate ones of the nests move along alternate ones of two generally parallel paths, and yet another aspect provides a label transport with a hold down member mounted for both pivotal and translational movement to accommodate tolerance variations so that articles of different diameters, for example, can be labeled. Still another aspect provides backup labelers to further increase system throughput.

In line with the above, a method of wrap around labeling according to the invention includes the steps of moving a article to be labeled in a first direction to a label applying station, and moving a label with an adhesive on a face thereof in a generally opposite second direction into the labeling station. The method proceeds by contacting the face of the label with the article at the labeling station while the label and the article are both moving to transfer the label to the article, and rotating the article to apply the label to the article.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
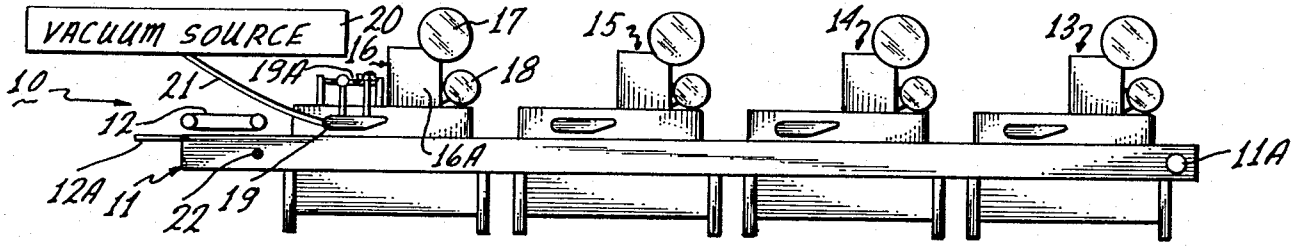
FIG. 1 of the drawings is a diagrammatic view of a labeling system constructed according to the invention that has four labeling stations.

Referring now to FIG. 1, there is shown a labeling system 10 constructed according to the invention. Generally, the system 10 includes a conveyor arrangement or conveyor 11 that is suitably powered by a conveyor drive motor 11A. Articles to be labeled (not shown) are moved along the conveyor 11 from a feed device 12 toward a plurality of label applicators 13–16. The feed device 12 employs known structure, such as a motor driven belt, to selectively propel articles to be labeled onto the conveyor 11. The articles to be labeled advance along a feed chute 12A to the feed device 12, and the feed device 12 is briefly activated to propel the furthermost one of the articles between the feed device 12 and the feed chute 12A onto the conveyor 11.

The various components may take any of various sizes and shapes depending on the precise labeling application. As an idea of size, however, the illustrated system 10 employs a conveyor 11 that is approximately waist high and arm's length wide for operator convenience. Also, the label applicators 13–16 extend upwardly from the conveyor 11 to eye level or slightly higher where they can be easily accessed by an operator.

Multiple label applicators are used for increased system throughput and for backup purposes. Each one of the label applicators provides a separate labeling station, and an article to be labeled is moved on the conveyor 11 past one of the label applicators 13–16 as a label is transferred to the article. Typically, the label applicators 13 and 14 serve as backup while the label applicators 15 and 16 label articles conveyed with the conveyor 11 along two generally parallel paths.

The label applicators 13–16 are generally similar so that only the label applicator 16 is described in further detail. It has a label dispensing assembly that includes a dispenser 16A having a supply reel 17, a take-up reel 18, and a peeler bar 71B (FIG. 4) subsequently described with which labels are dispensed to a label transport assembly 19. The label transport assembly 19 includes a support structure 19A subsequently described with reference to FIG. 4, this aspect of the label applicators 13–15 being omitted in FIG. 1 for illustrative convenience.

Conventional pressure-sensitive adhesive labels on a backing strip move from the supply reel 17 to the transport assembly 19 where the labels are dispensed as the backing strip continues on to the take-up reel 18. These components are subsequently described in further detail with reference to FIG. 4, along with a vacuum source 20 that is conventionally coupled to the label transport assembly 19 with a vacuum hose 21 for use in retaining the labels on the transport assembly 19. FIG. 1 also shows a sensor arrangement 22 that is used in feeding articles to the conveyor 11 at the appropriate time, and this is subsequently described in greater detail with reference to FIG. 2.

Figure 2:
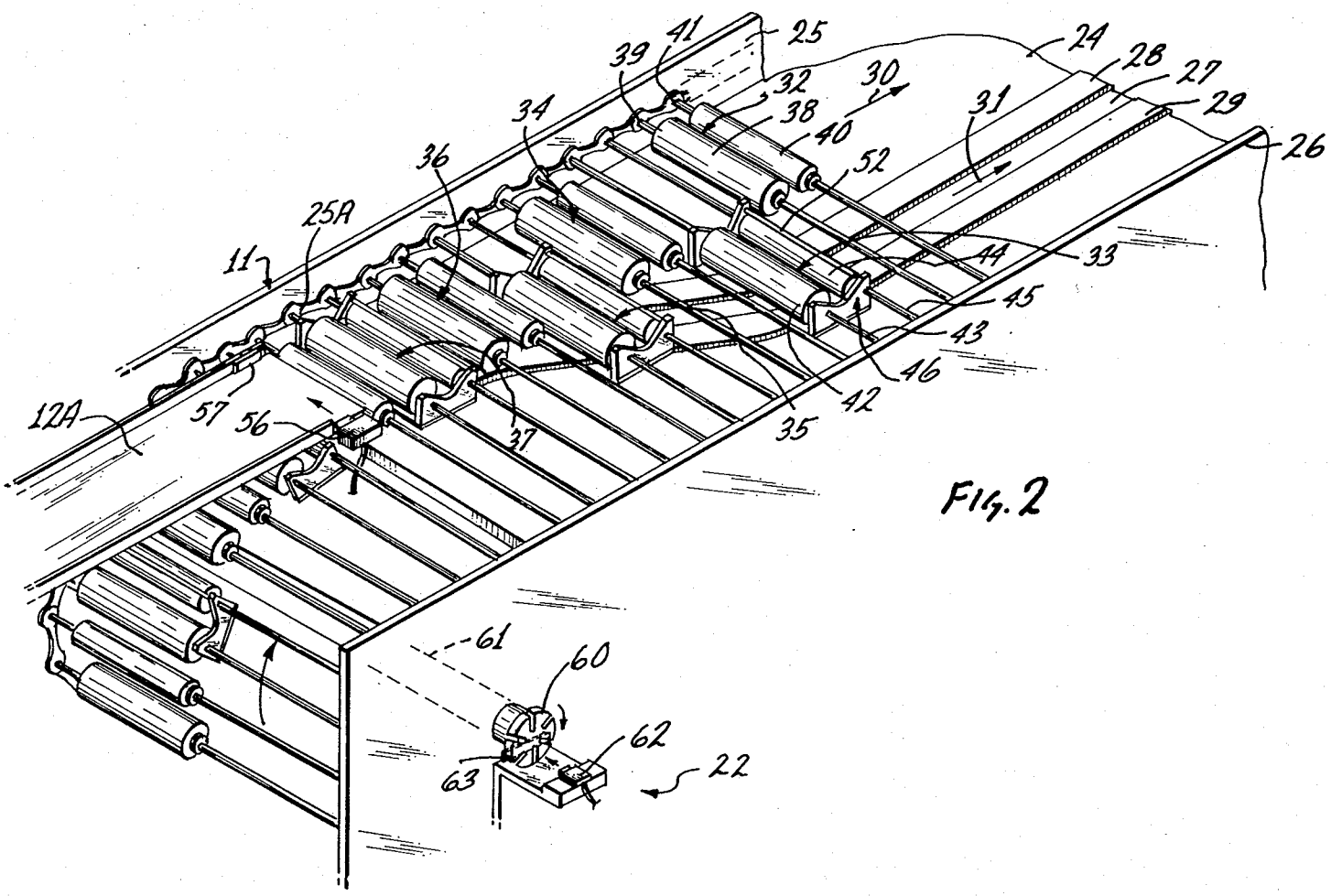
FIG. 2 is an enlarged perspective view of a portion of the conveyor.

Considering now FIG. 2, there is shown an enlarged perspective view of a portion of the conveyor 11. The conveyor 11 includes a bed 24 between sidewalls 25 and 26, and a track 27 between rails 28 and 29. Some articles to be labeled are moved along a path depicted by an arrow 30 in FIG. 2, and others are moved along a path depicted by an arrow 31, the arrow 31 lying along the track 27.

Thus, the system 10 includes means for splitting the flow of articles into two generally parallel paths as the articles are conveyed along the conveyor 11 in order to increase system throughput. In other words, two label applicators operate at the same time for an increased, combined labeling rate. Once the articles are labeled, the two paths may again converge into one path (not shown).

The conveyor 11 includes a plurality of nests that carry the articles to be labeled along the conveyor 11, nests 32–37 being representative. The nest 32 and every other nest thereafter, including the nests 34 and 36, move along the path depicted by the arrow 30, and the nest 33 and every other nest thereafter, including the nests 35 and 37, move along the path depicted by the arrow 31. Thus, the articles to be labeled move along two different paths, and this doubles system throughput, or the number or articles labeled in a given amount of time.

The first group of nests, nests 32, 34 and 36, are generally similar. Like the nest 32, they each include a rearward or trailing roller 38 rotatably mounted on a rearward shaft 39, and a forward or leading roller 40 rotatably mounted on a forward shaft 41. The shafts 39 and 41 are suitably mounted in parallel relationship on the sidewalls 25 and 26 by suitable means for movement in the direction of the arrow 30, the illustrated conveyor 11 employing movable link belts, such as a belt 25A in FIG. 2, that are powered by the motor 11A illustrated in FIG. 1. As the conveyor 11 operates, the nest 32 moves in the direction of the arrow 30 while the rollers 38 and 40 remain rotatable so that the article to be labeled can be rotated as subsequently described.

The rearward roller 38 projects above the forward roller 40 (see nest 32 in FIG. 4), the illustrated rearward roller 38 having a larger diameter for this purpose, and this arrangement inhibits rearward movement of the article within the nest during labeling. No article is shown on the nest 32 in FIG. 2, but the article might be a cylindrical can or a sausage in a soft cylindrical package, for example, with the article disposed on its side between the rollers 38 and 40.

The second group of nests, nests 33, 35, and 37, are also generally similar. Like the nest 33, they each include a rearward or trailing roller 42 mounted on a rearward shaft 43 and a forward or leading roller 44 mounted on a forward shaft 45. These rollers and shafts are generally similar to the rollers and shafts employed in the nest 32, with the rearward roller 42 projecting above the forward roller 44. The shafts 43 and 45 are suitably mounted on the sidewalls 25 and 26 for movement in the direction of the arrow 31.

Figure 3:
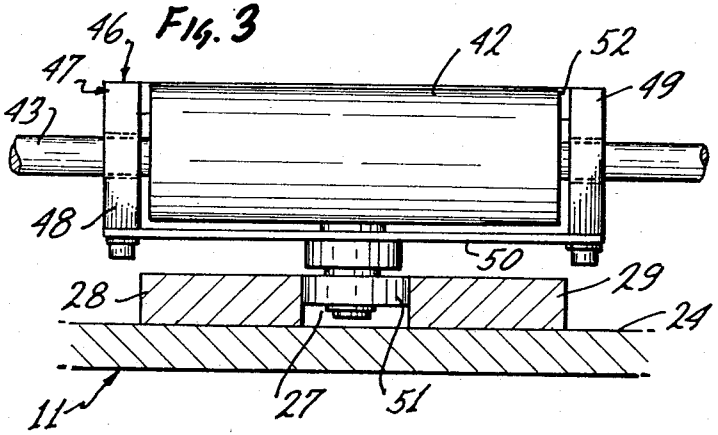
FIG. 3 is further enlarged elevational view of a divertable roller assembly.

However, the nest 33 includes a follower assembly 46 (FIGS. 2 and 3) that seats in the track 27 to guide the nest 33 along the path of the arrow 31. FIG. 3 shows details of the follower assembly 46, which includes a U-shaped frame 47 having side plates 48 and 49 and a bottom plate 50. These are dimensioned and arranged in the configuration illustrated to cradle the rollers 42 and 44, with the shafts 43 and 45 passing through the side plates 48 and 49.

Thus, the frame 47 can be moved generally transverse to the direction of the arrows 30 and 31, and as it is so moved, the nest 33 is also moved. A cam follower 51 attached to the bottom plate 50 follows the track 27 to move the frame 47 and the nest 33, along the path of the arrow 31. This results in articles to be labeled following two conveyor paths, the paths of the arrows 30 and 31 with such paths being parallel over major portions of their lengths. The follower assembly 46 also includes a bar 52 that spans the side plates 48 and 49 ahead of the forward roller 44 for added assembly rigidity.

In operation, an article to be labeled (not shown) is moved along the feed chute 12A (FIG. 2) by the feed device 12 toward the conveyor 11, while an article detector having a light source 56 and detector 57 that are conventionally arranged to produce a signal when light is blocked from passing from the source 56 to the detector 57, produces such a signal as an indication that the article is in a feed position. Then, the feed device 12 (FIG. 1) is stopped based on this information until the position of the nests as indicated by the sensor arrangement 22 is such that the feed device 12 can be restarted to feed an article to one of the nests. This results in the furthermost article on the feed chute 12A being transferred to the next nest and conveyed along the conveyor 11 toward the label applicators 13–16, along one of the paths depicted by the arrows 30 and 31.

The sensor arrangement 22, or nest detector, includes a slotted disc 60 that is rotatably coupled to the conveyor drive motor 11A by suitable means depicted in FIG. 2 by the dashed lines at 61. A light source 62 emits light toward a light detector 63, and as the disc 60 rotates, light is periodically transmitted through one of the slots in the disc 60 to result in an output signal from the detector 63 that is indicative of nest position. This signal is processed by suitable known means and used to activate the feed device 12 when a nest is in the correct position to receive an article.

This arrangement functions as feed means for depositing an article to be labeled in each of the nests as the nest moves past the article feed device 12. The article feed device has an outlet, i.e. the portion of the input ramp at which the article detector 56 is disposed. The article detector 56 functions as means responsive to one of the articles being adjacent the outlet for stopping the article feed device 12. The sensor arrangement 22 functions as means responsive to one of the nests being adjacent said outlet for starting the article feed device 12 to cause it to deposit the article into the nest.

Figure 4:
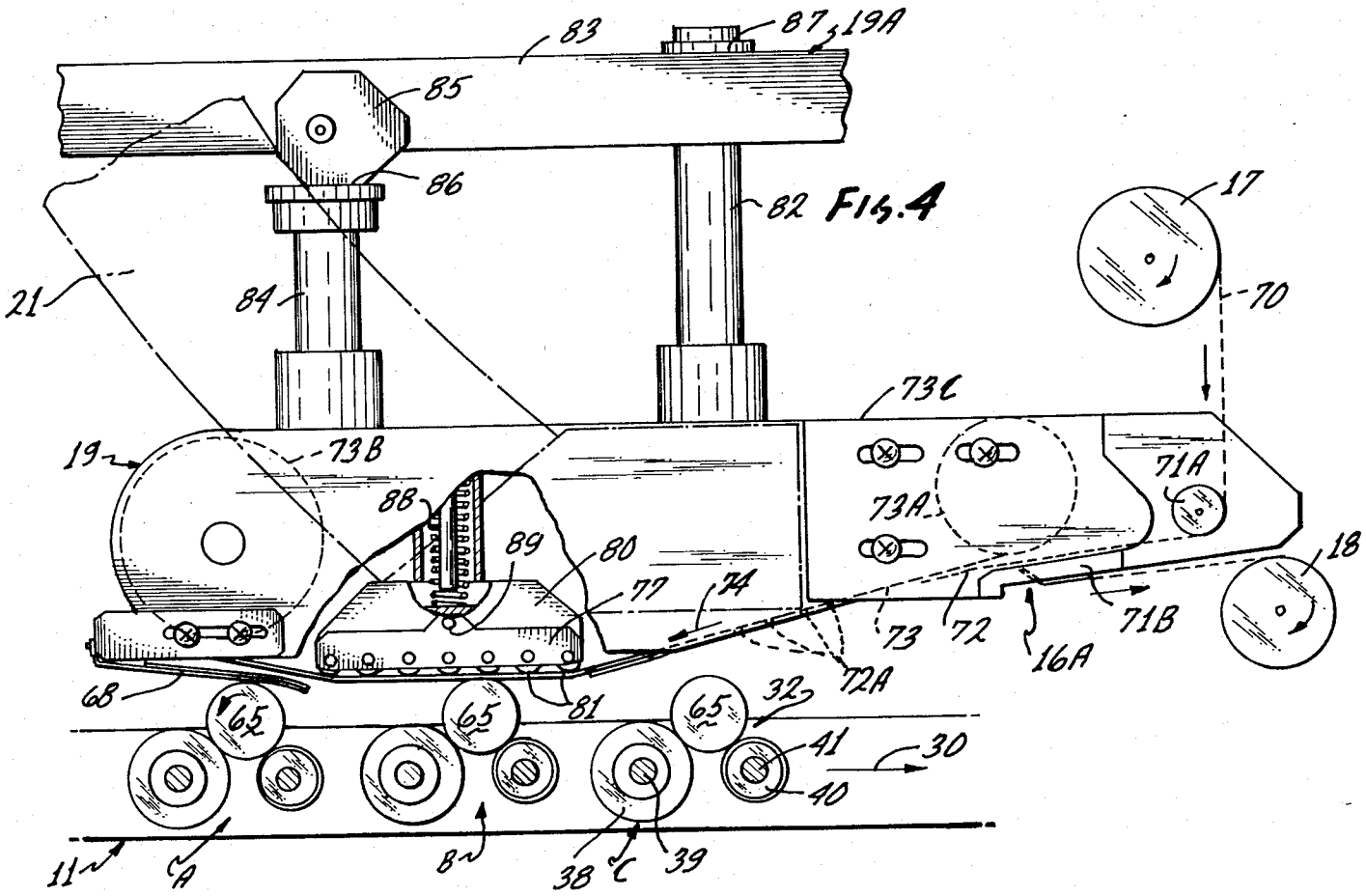
FIG. 4 is an enlarged elevational view of a label transport.

Further details of the label applicator 16 are shown in FIG. 4, where the nest 32 is shown in three positions that are labeled "A," "B," and "C." It is carrying an article 65, such as a sausage package, and it is moving in the direction of the arrow 30 past the transport assembly 19. As it does this, the article 65 first frictionally engages a stationary rotation initiator 68 mounted adjacent the conveyor 11, preferably on the transport assembly 19, at the "A" position. This prespins the articles to approximately one-half of its ultimate rotational speed in order to facilitate label application.

Then, the nest 32 moves on to the "B" position where a label is applied. A backing strip 70 is conventionally fed from the supply reel 17 past a guide roller 71A and over a peeler bar 71B to the take-up reel 18. A label 72 is dispensed from the backing strip 70 to a vacuum belt 73 as the backing strip passes over the peeler bar 71B, the label 72 being conventionally retained on the vacuum belt 73 by differential pressure acting through air passages 72A (a few of which are shown in FIG. 4) extending through the belt and conventionally produced by a vacuum coupled by the vacuum hose 21.

The vacuum belt 73 is an endless belt mounted on a suitable supporting structure of the transport assembly 19, such as rollers 73A and 73B on a support structure 73C in the form of a housing which, except for the air passages 72A is essentially air-tight, for movement in the direction of an arrow 74 (FIG. 4). For the region of the belt which confronts the conveyor 11, the direction 74 is opposite to the direction in which the conveyor 11 moves the article 65.

The transport assembly 19 includes a hold down member 77 within the housing 73C. The hold down member is mounted on a frame 80, and it includes a plurality of rollers 81 over which the vacuum belt 73 passes to cause a region of the vacuum belt 73 to confront the conveyor 11.

A first post 82 attached to the housing 73C passes through a plate 83 which forms part of th supporting structure for the labeling system 10, and a second post 84 attached to the housing 73C abuts a camming device 85 which is rotatably mounted on the plate 83 (FIG. 4). The camming device 85 is rotated until a desired surface, such as the surface 86, abuts the second post 84, and then an adjustable collar 87 is tightened on the first post 82 to restrain the first post 82 and thereby the hold down member 77 in a position with respect to the conveyor 11. This adjusts the spacing between the belt 73 and the conveyor 11 according to the general size of the articles to be labeled.

The hold down member 77 is mounted on the frame 80 which is mounted on the support structure or housing 73C so that it is constrained by suitable means (not shown) to move only generally toward and away from the conveyor. A spring 88 spring biases the hold down member 77 toward the conveyor 11 while still allowing movement away from the conveyor 11.

The hold down member 77 is also mounted for pivotal movement about an axis extending generally transverse to the direction in which the article 65 is moved and transverse to the direction in which the hold down member 77 is translated toward and away from the conveyor 11. This is accomplished by pivotally mounting the hold down member 77 on the frame 80 with a pin 89 (FIG. 4), to further allow the hold down member 77 to ride over the article 65, or to follow its shape during the labeling process. This feature accommodates dimensional variances or tolerances in the articles being labeled.

Moving between the "A" position and the "B" position, the article 65 contacts the vacuum belt 73 and this causes it to spin faster. For example, the vacuum belt 73 may travel at one hundred twenty feet-per-minute and the conveyor 11 at one hundred feet-per-minute. This results in a relative speed between the two of approximately two hundred twenty feet-per-minute, and the article spins accordingly.

The approaching article is optically sensed in a conventional manner and as the article 65 reaches the "B" position, it is met by a label traveling in the opposite direction on the vacuum belt 73, and the label is transferred to the article 65 as the article 65 rotates and moves to the "C" position. The belt 73 is driven by a motor (not shown) and the movement of the belt and the label dispensing function can be controlled, for example, in accordance with Crankshaw U.S. Pat. No. 4,124,429. The adhesive face of the label adheres to the article 65, and as the article spins and the vacuum belt 73 and article 65 move in opposite directions, the label encircles the article 65 until the label is fully transferred from the vacuum belt 73 to the article 65.

This technique results in a more rapid transfer of the label to the article 65 without increasing the speed of the conveyor 11. In other words, the relative motion of the label and the article 65 is increased without exceeding conveyor speed limitations, either for the conveyor 11 or the vacuum belt 73.

In addition to the foregoing, the system 10 includes means for mounting the label applicators 13–16 and associated transport assemblies for movement in a direction generally transverse to the direction in which the conveyor 11 moves the articles to be labeled. This enables use of any one of the label applicators 13–16 for labeling articles moving along either one of the two paths depicted by the arrows 30 and 31 in FIG. 2. It also permits movement toward an operator for repair or loading purposes. The label applicators 14 and 16 may be positioned over the path depicted by the arrow 30, for example, and the label applicators 13 and 15 over the other path.

Figure 5:
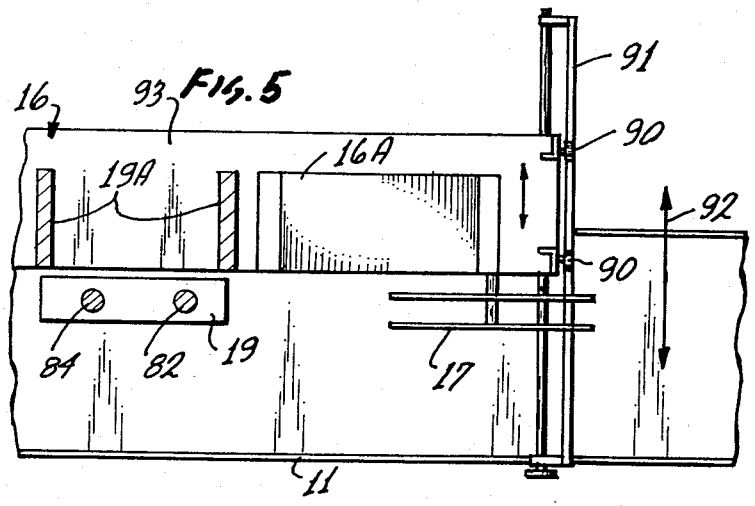
FIG. 5 is a top view of a portion of one labeling station illustrating transverse movement of the label applicator.

For this purpose, the transport assembly 19 and the label applicator are mounted with suitable components, such as a mounting plate 93 and rollers 90 on a track 91 (FIG. 5). The rollers 90 ride on the track 91, and the track 91 is mounted on suitable support structure (not shown) so that the track 91 overhangs the conveyor 11. This enables movement of the transport assembly 19 and the label applicator 16 back and forth over the conveyor 11 transverse to the flow of articles being labeled, as depicted by a double-headed arrow 92 in FIG. 5. Thus, this arrangement enables the transport assembly 19 and the label applicator 16 to be moved to and fixed in a desired position. In this regard, a rollers-and-track support arrangement would preferably employ two spaced apart tracks, both similar to the one track illustrated in FIG. 5.

Although an exemplary embodiment of the invention has been shown and described, many changes, modifications, and substitutions may be made by one having ordinary skill in the art without necessarily departing from the spirit and scope of this invention.

What is claimed is:

1. A method of wrap around labeling comprising:
moving an article to be labeled in a first direction to a label applying station;
moving a label with an adhesive on a face thereof in a second direction opposite to said first direction into the labeling station;
contacting the face of the label with the article at the labeling station while the label is moving in the second direction and the article is moving in the first direction to transfer the label to the article;
rotatably supporting the article;
moving the rotatably supported article past a rotation initiator;
rotating the article to apply the label to the article;
said step of rotating including contacting the article with the rotation initiator to initiate said step of rotation and to rotate the article at about a first rotational speed and increasing the rotational speed of the article by contacting the article with at least one of the belt and the label.

2. A method as defined in claim 1, wherein said step of moving a label is carried out on a belt and said step of rotating is initiated before the article contacts the label.

3. A method as defined in claim 1 wherein said step of rotating includes rotating the article about a generally horizontal rotational axis.

4. A labeling system comprising:
a conveyor for moving articles to be labeled in a first direction through a labeling station while allowing the article to be rotated;
a label transport for conveying labels from a label dispensing station to the labeling station with labels moving in a second direction at the labeling station;
label dispensing means for dispensing a label onto the label transport at the label dispensing station whereby the label transport can convey the label to the labeling station where the label contacts the article so that the label is transferred to the article;
said first and second directions being generally opposite to each other; and
said conveyor including means for mounting at least one of the articles for rotation about an axis and said labeling system including a stationary rotation initiator adjacent said conveyor, the rotatable article being engageable with the rotation initiator as the conveyor moves the article past the rotation initiator to initiate rotation of the article.

5. A labeling system comprising:
a conveyor for moving articles to be labeled in a first direction through a labeling station while allowing the article to be rotated;
a label transport for conveying labels from a label dispensing station to the labeling station with labels moving in a second direction at the labeling station;
label dispensing means for dispensing a label onto the label transport at the label dispensing station whereby the label transport can convey the label to the labeling station where the label contacts the article so that the label is transferred to the article;
said first and second directions being generally opposite to each other;
a plurality of nests; and
means for causing alternate ones of the nests to move past the labeling station along alternate ones of two generally parallel paths.

6. A labeling system as defined in claim 5, wherein at least one of said nests rotatably supports at least one of the articles and said one nest includes at least first and second rollers for supporting said one article therebetween.

7. A labeling system as defined in claim 6, wherein said first roller is a leading roller and said second roller is a trailing roller and said second roller projects above said first roller.

8. A labeling system as defined in claim 5, wherein said label transport includes:
a label transport supporting structure;
an endless belt;
means on the label transport supporting structure for mounting the belt for movement;
a hold down member for causing a region of said belt to confront the conveyor;
means for mounting said hold down member for translation generally toward and away from the conveyor; and
means for mounting said hold down member for pivotal movement about an axis extending generally transverse to said first direction and to the direction in which the hold down member can translate.

9. A labeling system as defined in claim 5, including means for mounting the label transport and the label dispensing means for movement in a direction generally transverse to said first direction.

10. A labeling system as defined in claim 5, including:
means for mounting said label transport for movement generally toward and away from the conveyor; and
a cam having a plurality of flat surfaces thereon for adjusting the spacing between the label transport and the conveyor.

11. A labeling system as defined in claim 5, wherein each of said nests is adapted to receive an article to be labeled, and said labeling system includes article feed means for depositing an article to be labeled in each of said nests as such nest moves past the article feed means, said article feed means having an outlet and means responsive to one of the articles being adjacent said outlet for stopping the article feed means and means responsive to one of the nests being adjacent said outlet for starting the article feed means to cause the article feed means to deposit such article into such adjacent nests.

12. A labeling system as defined in claim 5, wherein one of said nest mounts at least one of the articles for rotation about an axis and said labeling system includes a stationary rotation initiator adjacent said conveyor, the rotatable article being engageable with the rotation initiator as the conveyor moves the article past the rotation initiator to initiate rotation of the article.

13. A labeling system comprising:
a conveyor for moving articles to be labeled in a first direction through a labeling station while allowing the article to be rotated;
a label transport for conveying labels from a label dispensing station to the labeling station with labels moving in a second direction at the labeling station;
label dispensing means for dispensing a label onto the label transport at the label dispensing station whereby the label transport can convey the label to the labeling station where the label contacts the article so that the label is transferred to the article;

said first and second directions being generally opposite to each other;

said conveyor including a next for rotatably supporting at least one of the articles and said next includes at least first and second rollers for supporting said one article therebetween; and said first roller being a leading roller and said second roller being a trailing roller and said second roller projects above said first roller.

14. A labeling system comprising:

a conveyor for moving articles to be labeled in a first direction through a labeling station while allowing the article to be rotated;

a label transport for conveying labels from a label dispensing station to the labeling station with labels moving in a second direction at the labeling station;

label dispensing means for dispensing a label onto the label transport at the label dispensing station whereby the label transport can convey the label to the labeling station where the label contacts the article so that the label is transferred to the article;

said first and second directions being generally opposite to each other;

means for mounting said label transport for movement generally toward and away from the conveyor; and a cam having a plurality of flat surfaces thereon for adjusting the spacing between the label transport and the conveyor.

15. A labeling system comprising:

a conveyor for moving articles to be labeled in a first direction through a labeling station while allowing the article to be rotated;

a label transport for conveying labels from a label dispensing station to the labeling station with labels moving in a second direction at the labeling station;

label dispensing means for dispensing a label onto the label transport at the label dispensing station whereby the label transport can convey the label to the labeling station where the label contacts the article so that the label is transferred to the article;

said first and second directions being generally opposite to each other; and said conveyor including a plurality of nests, each of said nests being adapted to receive an article to be labeled, and said labeling system includes article feed means for depositing an article to be labeled in each of said nests as such next moves past the article feed means, said article feed means having an outlet and means responsive to one of the articles being adjacent said outlet for stopping the article feed means and means responsive to one of the nests being adjacent said outlet for starting the article feed means to cause the article feed means to deposit such article into such adjacent nests.

* * * * *

UNITED STATES PATENT AND TRADEMARK OFFICE

CERTIFICATE OF CORRECTION

PATENT NO. : 4,830,701

DATED : May 16, 1989

INVENTOR(S) : Michael Crankshaw et al

It is certified that error appears in the above-identified patent and that said Letters Patent is hereby corrected as shown below:

Title Page,
Abstract, line 18 after "label" insert -- with the article at the labeling station while the label --.

Column 1, line 63 change "th" to -- the --.

Column 5, line 48, change "th" to -- the --.

Column 9, line 3 change "next" to -- nest --.

Column 9, line 4 change "next" to -- nest --.

Signed and Sealed this

Fifteenth Day of May, 1990

*Attest:*

HARRY F. MANBECK, JR.

*Attesting Officer*

*Commissioner of Patents and Trademarks*